US009815679B2

(12) United States Patent
Weaver et al.

(10) Patent No.: US 9,815,679 B2
(45) Date of Patent: Nov. 14, 2017

(54) LIQUID DISPENSING SYSTEM

(75) Inventors: Kerry Lloyd Weaver, Florence, KY (US); Kyle Vincent Zink, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 793 days.

(21) Appl. No.: 13/529,646

(22) Filed: Jun. 21, 2012

(65) Prior Publication Data

US 2013/0341355 A1 Dec. 26, 2013

(51) Int. Cl.

| | |
|---|---|
| ***B67D 1/16*** | (2006.01) |
| ***B67D 3/00*** | (2006.01) |
| *A47F 1/03* | (2006.01) |
| *B67D 1/06* | (2006.01) |

(52) U.S. Cl.

CPC ..... *B67D 3/0035* (2013.01); *B67D 1/16* (2013.01); *A47F 1/03* (2013.01); *B67D 1/06* (2013.01); *B67D 3/00* (2013.01); *B67D 3/0029* (2013.01)

(58) Field of Classification Search

CPC ... B67D 1/16; B67D 1/06; B67D 3/00; B67D 3/0029; B67D 3/0035; A47F 1/03

USPC ..... 222/108–111, 180–181.1, 185.1, 325, 222/460–462, 570

See application file for complete search history.

(56) References Cited

U.S. PATENT DOCUMENTS

| | | | | |
|---|---|---|---|---|
| 4,173,295 | A * | 11/1979 | Steinmann | 222/81 |
| 4,260,078 | A * | 4/1981 | Kephart | 222/184 |
| 5,104,003 | A * | 4/1992 | Stecoza | 222/83.5 |
| 5,509,583 | A * | 4/1996 | Dolson | 222/185.1 |
| 5,713,492 | A * | 2/1998 | DeGennaro | 222/153.03 |
| 6,283,330 | B1 * | 9/2001 | Gillespie et al. | 222/145.7 |
| 6,491,189 | B2 * | 12/2002 | Friedman | B67D 3/043 222/509 |
| 6,935,535 | B2 * | 8/2005 | Pandolfi et al. | 222/146.5 |
| 8,464,917 | B2 * | 6/2013 | Nini | B67D 3/0045 222/481.5 |
| 9,580,290 | B1 * | 2/2017 | Gallagher | B67D 3/0083 |
| 2015/0353243 | A1 * | 12/2015 | Stryker | B65D 47/06 222/173 |

FOREIGN PATENT DOCUMENTS

| | | |
|---|---|---|
| JP | H09 142585 A | 6/1997 |
| JP | 2009 120221 A | 6/2009 |
| WO | WO 03/068665 A1 | 8/2003 |

OTHER PUBLICATIONS

International Search Report for International Application Serial No. PCT/US2013/046697, mailed Oct. 2, 2013, 9 pages.

* cited by examiner

*Primary Examiner* — Paul R Durand
*Assistant Examiner* — Andrew P Bainbridge
(74) *Attorney, Agent, or Firm* — Gary J. Foose

(57) ABSTRACT

A liquid dispensing system.

14 Claims, 7 Drawing Sheets

LIQUID DISPENSING SYSTEM

FIELD OF THE INVENTION

Liquid dispensing system.

BACKGROUND OF THE INVENTION

Installing a container of liquid in a liquid dispensing system can be cumbersome to many consumers. For instance, in common stand-alone water coolers, the consumer or water cooler service provider installs a container of water that may have a volume of about 20 L by removing a cap and rapidly inverting the container and seating the neck of the container in a water cooler housing. Since the steps of inverting the container and seating the neck of the container cannot be preformed instantaneously, water is sometimes spilled on the floor or water is released from the container into the housing.

If the liquid is water, a spill may not be of particular concern since many materials are water resistant such that a spill does not damage property and water is a relatively inexpensive liquid. If the liquid is something that could result in damage to property or is dearer than water, a spill may be of concern.

Once the container is installed in the dispensing system, the water is then dispensed through a tap that is part of the housing. The consumer buys containers of water and reuses the dispensing system.

Liquid laundry detergents can also be dispensed through a tap. For instance, containers of liquid laundry detergent are marketed with a press tap installed in the container. One problem with this approach is that press taps can be expensive. Press taps can be durable enough such they can be reused, if the consumer is provided with an easy to use system that accommodates reuse. A liquid dispensing system for liquid laundry detergent that is like that for water could be adopted but the problems associated with spilling make that particular approach unattractive. Liquid laundry detergent has a high surfactant content and is more viscous than water, which makes the liquid slippery to the touch and results in a spill that tends to be at least partially retained on a surface. If the liquid laundry detergent remains on the surface it may collect dust or result in a slippery surface, which can be particularly problematic if the surface is a floor. Further, liquid laundry detergent can be expensive, so spillage can be a significant loss to a consumer.

With these limitations in mind, there is a continuing unaddressed need for a liquid dispensing system that results in less spillage.

SUMMARY OF THE INVENTION

A liquid dispensing system. The liquid dispensing system can comprise a base having a drip tray receptacle. The liquid dispensing system can comprise a pedestal extending from the base and elevated relative to the base. The pedestal can have a housing defined by a floor having a floor edge and a peripheral wall extending from the floor edge to a container support section. The container support section can have a recessed portion. The liquid dispensing system can have a connecting member positioned within the housing between the floor and the container support section. The liquid dispensing system can comprise a conduit extending from the connecting member and in liquid communication with the container. The conduit can be sized and dimensioned to provide for flow of a viscous liquid. The conduit can be sized and dimensioned to fit in the recessed portion.

DETAILED DESCRIPTION OF THE INVENTION

Figure 1:
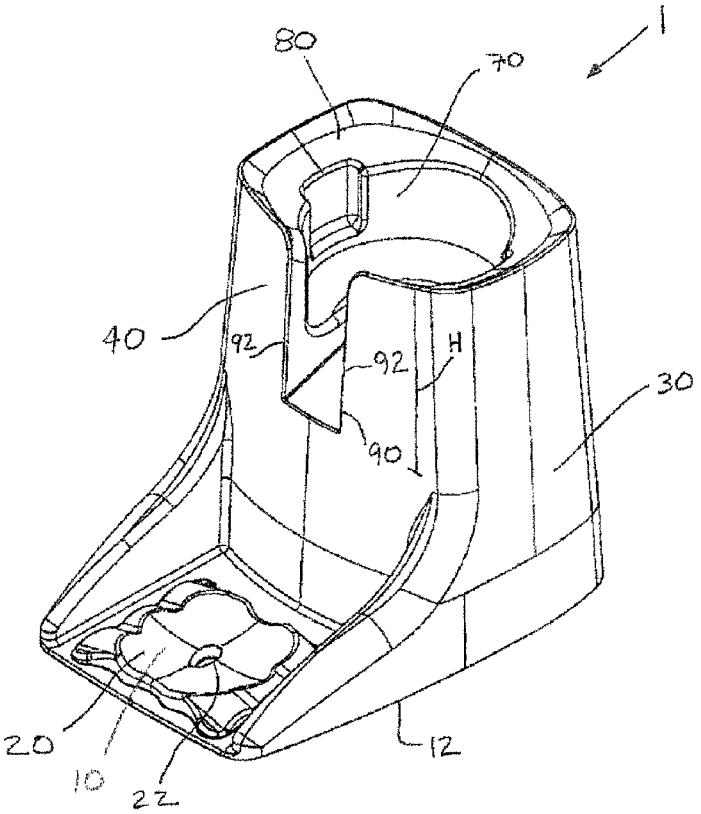
FIG. 1 is a perspective view of the base and pedestal of a liquid dispensing system.

A liquid dispensing system 1 is shown in FIG. 1. The liquid dispensing system 1 can have a base 10 having a drip tray receptacle 20. The base 10 can be an injection molded plastic part formed of a thermoplastic or thermoset material. The molded plastic part can be formed from materials selected from the group consisting of epoxy, phenolic, nylon, polyethylene, polypropylene, polystyrene, and mixtures thereof.

The base 10 can have a generally flat portion that is parallel to a surface upon which the base 10 rests, such as a table or top surface of a washing machine or dryer. Within that generally flat portion, can be a drip tray receptacle 20. The drip tray receptacle 20 can be a portion of the base 10 that is sized and dimensioned to receive a drip tray. The drip tray receptacle 20 can be a plane surface upon which a drip tray rests. The drip tray receptacle 20 can be depressed portion or a raised portion of the base 10.

The base 10 can have a flat portion 12 that can be rested upon a table surface or top surface of a washing machine, dryer, shelf, or table. The base 10 can have an open portion 22. The open portion 22 can be aligned with the outlet of a tap dispenser that can be employed in the liquid dispensing system so that when a liquid is dispensed from the outlet, the liquid can pass through the base 10 without contacting the base 10. The open portion 22 can provide for direct tap dispensing into a top loading washing machine without the use of a dosing cup, if desired by the consumer. The open portion 22 can be an aperture having an area between about 0.5 $cm^2$ and about 25 $cm^2$. The open portion 22 can be an aperture having an area between about 0.5 $cm^2$ and about 10 $cm^2$. The open portion 22 can be an aperture having an area of more than about 0.5 $cm^2$, more than about 1 $cm^2$, or more than about 2 $cm^2$.

The liquid dispensing system 1 can further comprise a pedestal 30 extending from the base 10. The pedestal 30 can be elevated relative to the base 10 meaning that when the liquid dispensing system is resting on a table or other flat surface, the pedestal 30 is higher than the base 10. The pedestal 30 can be a part that is integrally molded with the base 10 or can be a separate part joined to the base 10. The pedestal 30 and the base 10 can be integrally molded with one another in a single injection molding step. The pedestal 30 can be formed of the same materials as set forth previously for the base 10. The pedestal 30 is the part of the liquid dispensing system that provides for elevation head for the liquid within a container to drive flow when the liquid is dispensed.

Figure 2:
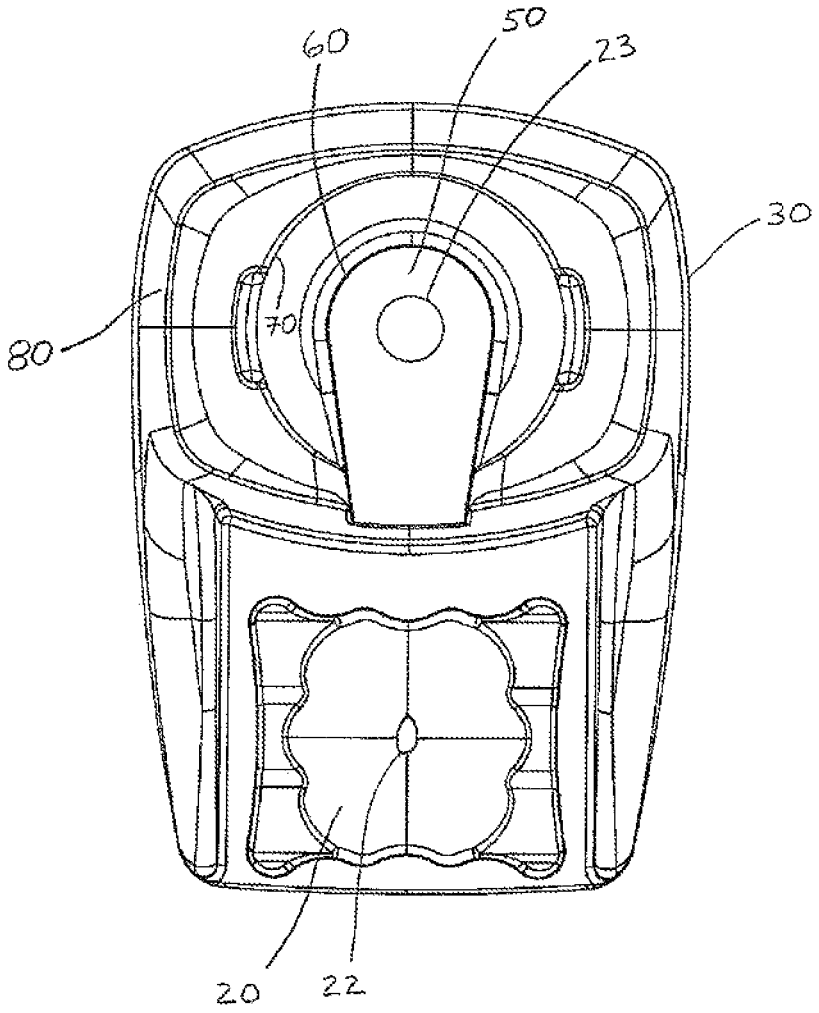
FIG. 2 is a top view of a liquid dispensing system.

The pedestal 30 can have a housing 40. The housing 40 can be defined by a floor 50 having a floor edge 60 and a peripheral wall 70 extending from the floor edge 60 to a container support section 80 (FIGS. 1 and 2). The container support section 80 can provide for support of a container that is installed in or on the pedestal 30. That is, the container can rest on the container support section 80. The container support section 80 can have three or more spaced apart locations that are level with one another. The three or more spaced apart locations level with one another can support a container installed in or on the pedestal 30. The entire support section 80, except for the recessed portion 90, can be level. The support section 80 can have an irregular contour yet still provide for a stable resting surface for an inverted container.

The container support section 80 can have a recessed portion 90. The container support section 80 can be above the recessed portion 90. The housing 40 can provide for a void in which can rest part of the container of liquid. The housing 40 can provide for static stability of the container. The housing 40 can provide for a void in which can rest appurtenances that are connected the container of liquid, such as a press tap system. The recessed portion 90 can provide a pathway for a conduit that conducts flow of liquid from the container resting in or on the pedestal 30. The floor 50 can include an aperture 23 that can provide for an outlet for any liquid that might be leaked into the housing 40 by a faulty connection between the container and the press tap system. By having an aperture 23 placed as such, liquid will not accumulate in the housing 40 and then possibly subsequently uncontrollably spill out through recessed portion 90 in the front of the liquid dispensing system.

The container support section 80 can have a container support section length that is defined by the length about the container support section 80. The recessed portion 90 can comprise less than about 20% of the container support section length. The recessed portion 90 can comprise less than about 10% of the container support section length. The recessed portion 90 can comprise less than about 50% of the container support section length. By having the recessed portion 90 comprise a relatively small fraction of the container support section length, it may be easier for the consumer to identify how the container and any attached appurtenances should be oriented to arrange the liquid dispensing system 1 in a manner such that it is convenient to dispense liquid.

The peripheral wall 70 can have a peripheral wall height H that is defined as the minimum straight-line distance between the floor 50 and the container support section 80 away from the recessed portion 90. The recessed portion 90 can extend to a depth of at least about 50% of the peripheral wall height. The recessed portion 90 can extend to a depth of at least about 60% of the peripheral wall height. The recessed portion 90 can extend to a depth of at least about 70% of the peripheral wall height. The recessed portion 90 can extend to a depth of at least about 80% of the peripheral wall height. The recessed portion 90 can extend to a depth of at least about 90% of the peripheral wall height. Without being bound by theory, it is thought that by having a deeper recessed portion 90 the center of gravity of the liquid dispensing system 1 can be lowered relative to the surface upon which the liquid dispensing system 1 rests. Such lowering of the center of gravity may be of greater importance when the container of liquid is installed to be part of the liquid dispensing system 1. Lowering the center of gravity can make the dispensing system 1 more statically stable, as opposed to a dispensing system 1 having a higher center of gravity.

The recessed portion 90 can be defined by a substantially rectangular shape. The rectangular shape can be oriented such that an axis of the shape is substantially orthogonal to the base 10. That is, the recessed portion 90 can define a slot, which is a substantially linearly shaped opening having substantially straight side walls 92. A recessed portion 90 that is a substantially rectangular shape might be desirable for providing a tight conformance between the container and the pedestal 30. Having an axis of the rectangular shape substantially orthogonal to the base 10 might be beneficial in that when the container and associated appurtenances are inserted into the housing 40, the container may not rotate. If the container does not rotate as it is inserted into the housing and the axis of the rectangular shape is not substantially orthogonal to the base, an appurtenance associated with the container may become disconnected from the container, stressed, or loosened from the container.

Figure 3:
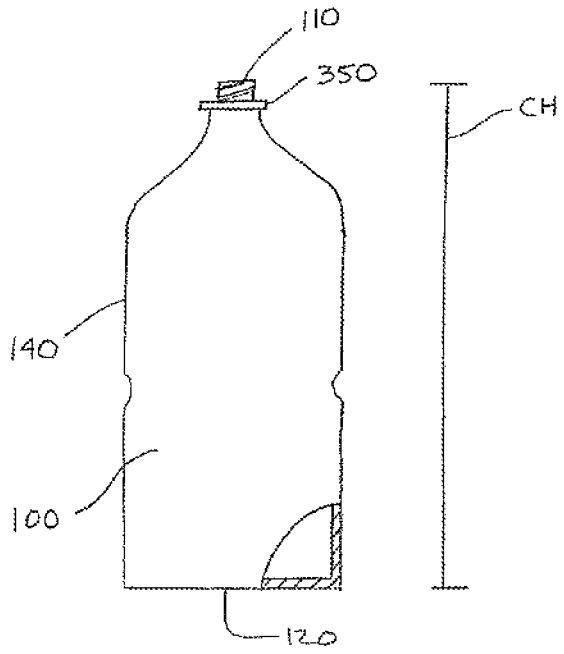
FIG. 3 is a container, a portion of which is rendered in a sectional view.

The liquid dispensing system 1 can further comprise a container 100 (FIG. 3) on said pedestal 30 and supported by the container support section 80. The container can be at least partially within the housing 40 or on the pedestal 30. The container 100 can have an open end 110 and a base 120 opposing the open end 110. The container 100 can have a peripheral lip 350 proximal to the open end 110. The peripheral lip 350 need not extend completely around the open end 110. The container can have a sidewall(s) 140 extending from the periphery of the base 120. Between the sidewall(s) 140 and the open end 110, the container 100 can have a neck 130. The neck 130 can be a portion of the container 100 in which the shape of the bottle is tapered between the sidewall(s) 140 and the open end 110. The container 100 can have a container height CH extending between the base 120 of the container 100 and the open end 110 of the container. The distance between the floor 50 and the peripheral wall 70 away from the recessed portion 90 can be greater than 10% of the container height CH.

Figure 4:
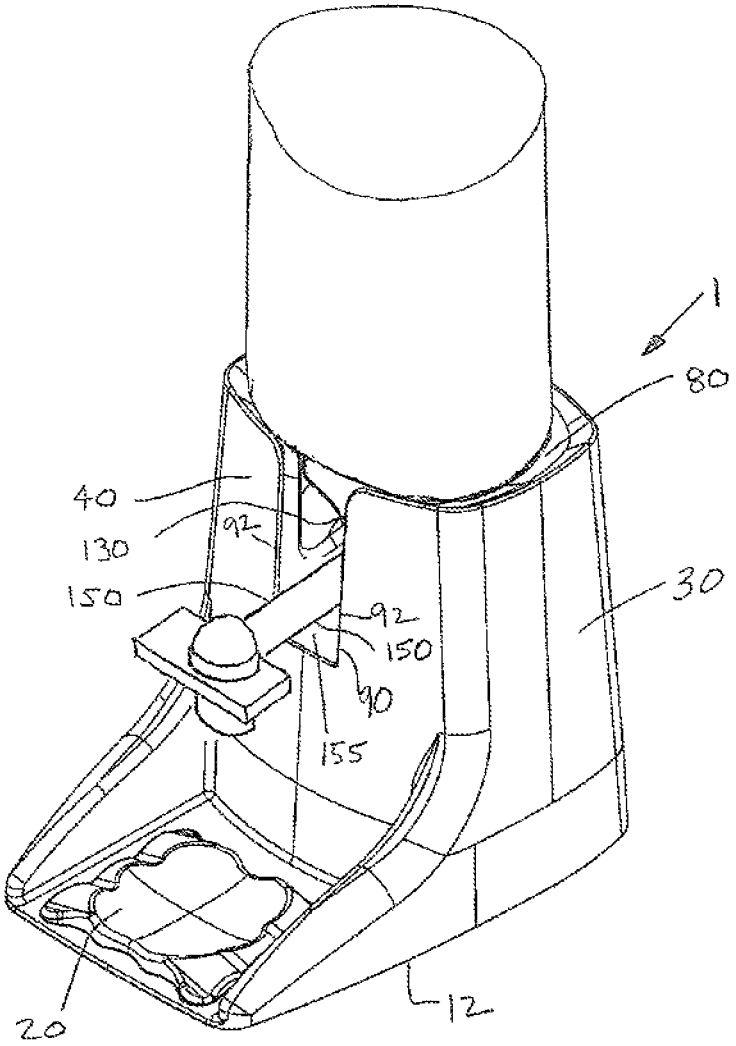
FIG. 4 is a perspective view of a liquid dispensing system.

As shown in FIG. 4, the open end 110 and at least a portion of the neck 130 of the container 100 can be in the housing 40 of the pedestal 30. Such an arrangement can be practical for lowering the center of gravity of the liquid dispensing system 1 so as to reduce the potential for the liquid dispensing system 1 to tip over. Further, it can be desirable to have the container 100 supported around a majority of the neck, or even around more than 75% of the neck 130 so as to reduce the stress on the container 100. The container 100 can be supported by the container support section 80. Such an embodiment can be practical because it effectively lifts the container up above the floor 50 and creates space for a connecting member. This allows for all of viscous liquid to drain from the container 100 into the connecting member and out through the conduit 150 without having to tip the entire liquid dispensing system to drain the entire contents of the container 100, unlike typical bag-in-box approaches. The container support section 80 can support the container 100 at locations between the open end 110 and the sidewall 140. The conduit 150 can be sloped downwardly from the connecting member to provide for gravity drainage. An embodiment in which the container 100 rests upon the floor 50 can be less practical because in such an arrangement the connecting member and conduit are not the lowest elements in the liquid dispensing system and the user must tip the liquid dispensing system to drain the entire contents of the container 100, which can be inconvenient and result in a spill or tipping over/dropping of the liquid dispensing system 1.

A connecting member can be operatively engaged with the container 100. There can be a conduit 150 extending from the connecting member and be in liquid communication with the container 100. The conduit 150 can be sized and dimensioned to provide for flow of a viscous liquid from the container 100. The conduit 150 can be a tube having a substantially circular cross section having an inside diameter between about 1 mm and about 20 mm. The conduit 150 can be tube having a substantially circular cross section having an outside diameter between about 5 mm and about 30 mm. The conduit 150 can be made of a material selected from the group consisting of metal, plastic, ceramic, cellulosic material, and combinations thereof. The conduit 150 can contact a bottom 155 of the recessed portion 90, the bottom 155 extending between the sidewalls 92 of the recessed portion 90. By having the conduit 150 in contact with the bottom 155 of the recessed portion 90, the conduit 150 can be supported in the event that the conduit 150 is torqued about the container 100 which might reduce the potential for a break in the conduit 150 or a leak otherwise.

Figure 5:
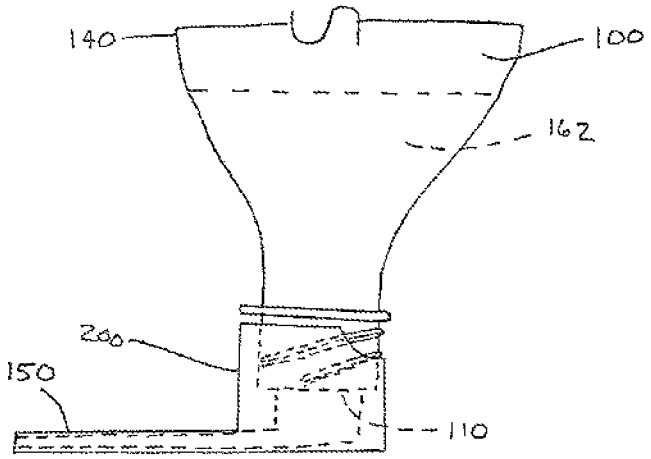
FIG. 5 is profile view of a conduit and connecting member connected to a container.

As shown in FIG. 5, the connecting member 200 can be operatively engaged with the container 100 and in fluid communication with the conduit 150. Such engagement can be provided by corresponding threads in the connecting member 200 and the open end 110, by way of non-limiting example. Such engagement can be provided for by a compression fitting on the connecting member 200 that is operatively engageable with the open end 110 of the container 100, by way of non-limiting example. The connecting member 200 can facilitate transport of the liquid in the container 100 to the conduit 150. The connecting member 200 can be sealingly engaged with the container 100, so as to prevent leakage of the liquid from the interface between the connecting member 200 and the container 100.

The connecting member 200 can be joined directly with the floor 50 and/or pedestal 30. The connecting member 200 can be integral with the floor 50 and/or pedestal 30.

Figure 6:
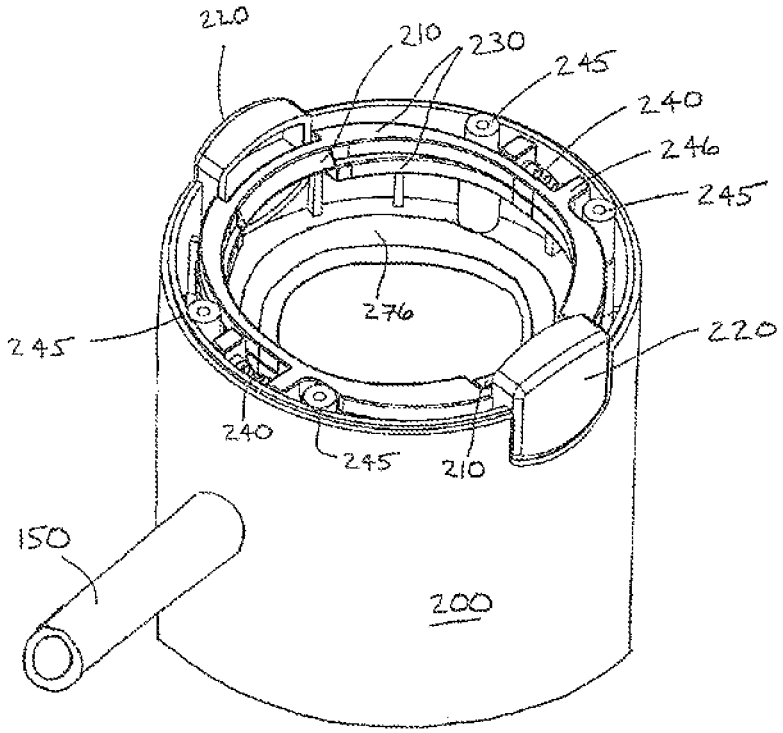
FIG. 6 a perspective view of a connecting member.

A non-limiting example of a connecting member 200 that can be employed in the liquid dispensing device 1 is shown in FIG. 6. The connecting member 200 can be any structure that is capable of sealingly engaging the container 100 with the conduit 150. In the view shown in FIG. 6, the container 100 would be installed from above so that the open end 110 is oriented towards bottom of the figure.

The connecting member 200 can comprise a moveable latch 210. The connecting member 200 can comprise a plurality of moveable latches 210. The latch 210 or latches 210 can be operably engageable with a peripheral lip 350 of the container 100. The latch(es) 210 can be translationally mounted within the connecting member 200. One or more arms 230 can extend from the moveable latch 210 to a button 220 opposing the moveable latch 210. Movement of the button 220 in and out moves the arm(s) 230 which moves the latch 210.

As shown in FIG. 6, which is a partial view of a connecting member 200, the connecting member 200 can comprise two latches 210 on opposing sides of the connecting member 200. The connecting member 200 shown in FIG. 6 could be provided with a ring or washer to cover the moving parts located within the connecting member and a decorative shroud.

In the embodiment shown in FIG. 6, the arm(s) 230 that drive movement of each latch 210 can be layered upon one another. The latch(es) 210 can be biased to be in a position for engaging with a peripheral lip 350 of a container 100. The latch(es) can contact more than about 1% of the circumference of the peripheral lip 350, more than about 10% of the circumference of the peripheral lip 350, more than about 25% of the circumference of the peripheral lip 350, more than about 33% of the circumference of the peripheral lip 350, or about 50% of the circumference of the peripheral lip 350.

The bias can be provided by one or more springs 240, a spring being a structure that deforms under load and substantially returns to its original shape after unloading, within the range of applied loads within the connecting member. The spring(s) 240 can be a resilient material or structure that exhibits linear-elastic behavior within the range of applied stresses and loads. The springs 240 can connect the arms 230 of one latch 210 with the arm of another latch 210 and be biased to maintain the latches 210 towards the center of the 200 connecting member 200. When the button(s) 220 is depressed, the arm 230 moves the latch 210 in a direction away from the center of the connecting member 200 to allow release of the peripheral lip 350 and loads the spring 240. Upon release of the button(s) 220, the latches 210 move back towards the center of the connecting member 200 and engage with the peripheral lip 350 of the container 100, if present. The range of motion of the latches 210 can be constrained by one or more posts 245 between which a tab 246 on the arm 230 can move, the post(s) 245 being joined to the connecting member 200. When the button(s) 220 is in a released position, the latch(es) can engage with a peripheral lip 350 on the container 100. The depth of the connecting member 200 can be coordinated with the location of the peripheral lip 350 on the container 100 so that when the latches are 210 are latched onto the peripheral lip 350, the open end 110 of the container 100 is abutted with a sealing gasket 276 to provide a leak tight seal between the connecting member 200 and the container 100. Downstream of the sealing gasket 276 can be the conduit 150.

As shown in FIG. 6, when the button 220 on the right side of the figure is depressed, the arm 240 drives movement of the latch 210 that is on the opposite side of the connecting member 200 from the button 220 that is depressed, the latch 210 moving away from the center of the connecting member 200. Concurrently, spring 240 in the upper right portion of FIG. 6 is loaded in compression.

Figure 7:
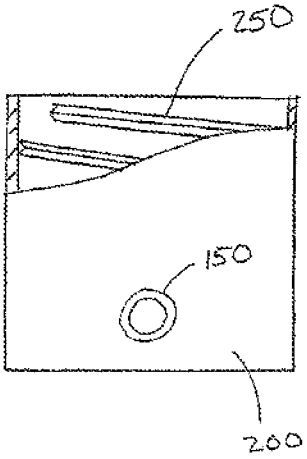
FIG. 7 is a connecting member, a portion of which is rendered in sectional view.

The connecting member 200 can be threaded, for example with a thread 250 or threads 250 (FIG. 7). The thread(s) 250 can be sized and dimensioned to coordinate with corresponding thread(s) 250 at the open end 110 of container 100. Such an embodiment might be desirable because threaded connections tend to be structurally stable, strong, and can be free from leaks. In an alternative embodiment, the connecting member 200 can be rotatably mounted in the pedestal 30 so as to allow the connecting member 200 to be screwed to the open end 110 of the container 100.

The conduit 150 can be sized and dimensioned to conformably fit in the recessed portion 90. By conformably fit it is meant that the conduit 150 and the recessed portion 90 are sized and dimensioned such that there is no more than 10 mm of clearance between the conduit 150 and the recessed portion 90 at any one location. It can be practical to size and dimension the conduit 150 and the recessed portion 90 to have no more than 8 mm of clearance between the conduit 150 and the recessed portion 90 at any one location. It can be practical to size and dimension the conduit 150 and the recessed portion 90 to have no more than 5 mm of clearance between the conduit 150 and the recessed portion 90 at any one location. It can be practical to size and dimension the conduit 150 and the recessed portion 90 to have no more than 2 mm of clearance between the conduit 150 and the recessed portion 90 at any one location. The conduit 150 can have an outside diameter of 10 mm and the recessed portion 90 can have sidewalls 92 spaced apart from one another by 10 mm to 12 mm, by way of non-limiting example.

By having the conduit 150 conformably fit in the recessed portion 90, when the consumer installs the container 100 with the connecting member 200 and conduit 150 operatively engaged with the container 100, the conduit 150 slips into the recessed portion 90 conformably with little tolerance for movement of the conduit 150. This can provide for a signal to the consumer that liquid dispensing system 1 is ready for use. Further, little movement can be desirable since large movements might have the potential to dislodge the connecting member 200 from the container 100, resulting in a spill or leakage.

The container can contain a laundry detergent 162. The laundry detergent 162 can comprise a surfactant. A surfactant is a substance that lowers the surface tension of water. The laundry detergent can comprise an anionic surfactant. The laundry detergent 162 can have components selected from the group consisting of surfactant, brightener, bleach, softening agent, wrinkle releaser, scent, microencapsulated perfume, suds suppressor, chelant, free perfume, builder, and combinations thereof. The laundry detergent 162 can be, by way of non-limiting example, any of the liquid laundry detergents marketed as of May 1, 2012, under the brand name TIDE, by The Procter & Gamble Co., Cincinnati, Ohio.

Figure 8:
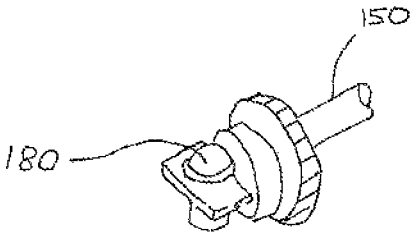
FIG. 8 is a perspective view of a tap.

The liquid dispensing system 1 can comprise a tap 180 attached to the conduit 150, a non-limiting embodiment of which is shown in FIG. 8. The tap 180 can be a press tap in which a button is depressed to displace a stopper in the outlet of the press tap 180. The tap 180 can comprise a ball valve, a butterfly valve, a globe valve, a gate valve, a diaphragm valve. The tap 180 can be the same as that marketed as of May 1, 2012, under the brand name TIDE, by the Procter & Gamble Co., Cincinnati, Ohio.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dispensing system comprising:

a base having a drip tray receptacle;

a pedestal extending from said base and elevated relative to said base, said pedestal having a housing defined by a floor having a floor edge and a peripheral wall extending from said floor edge to a container support section; wherein said container support section has a recessed portion;

a connecting member positioned within said housing between said floor and said container support section; and a conduit extending from said connecting member, said conduit sized and dimensioned to provide for flow of a viscous liquid, wherein said conduit is sized and dimensioned to fit in said recessed portion;

wherein said base has an open portion and a tap is attached to said conduit, wherein said open portion is aligned with an outlet of said tap dispenser so that when a liquid is dispensed from said outlet, said liquid can pass through said base without contacting said base.

2. The liquid dispensing system according to claim 1, wherein said container support section has a container support section length, wherein said recessed portion comprises less than 20% of said container support section length.

3. The liquid dispensing system according to claim 1, wherein said peripheral wall has a peripheral wall height defined as the minimum straight line distance between said floor and said container support section away from said recessed portion, wherein said recessed portion extends to a depth of at least 50% of said peripheral wall height.

4. The liquid dispensing system according to claim 1, wherein said drip tray receptacle comprises a depressed portion or a raised portion.

5. The liquid dispensing system according to claim 1, wherein said recessed portion is defined by a substantially rectangular shape.

6. The liquid dispensing system according to claim 1, wherein said conduit is sized and dimensioned to conformably fit in said recessed portion.

7. The liquid dispensing system according to claim 1, wherein said recessed portion has a bottom and said conduit is in contact with said bottom.

8. The liquid dispensing system according to claim 1, wherein said liquid dispensing system further comprises a container operatively engaged with said connecting member and in fluid communication with said conduit.

9. The liquid dispensing system according to claim 8, wherein said container contains a laundry detergent.

10. The liquid dispensing system according to claim 8, wherein said container has a container height extending between a base of said container and an open end of said container, wherein the distance between said floor and said container support section away from said recessed portion is greater than 10% of said container height.

11. The liquid dispensing system according to claim 1, wherein three or more spaced apart locations on said container support section are level with one another.

12. The liquid dispensing system according to claim 1, wherein a tap is attached to said conduit.

13. The liquid dispensing system according to claim 1, wherein there is an open portion in said base.

14. The liquid dispensing system according to claim 1, wherein there is an aperture in said floor.

* * * * *